US009033339B2

(12) United States Patent
Kato

(10) Patent No.: US 9,033,339 B2
(45) Date of Patent: May 19, 2015

(54) PAPER SHEET STACKING APPARATUS, IMAGE FORMING APPARATUS, PAPER SHEET PROCESSING APPARATUS, IMAGE FORMING SYSTEM AND METHOD FOR CONTROLLING PAPER SHEET STACKING OPERATION

(71) Applicant: KONICA MINOLTA, INC., Chiyoda-ku, Tokyo (JP)

(72) Inventor: Norishige Kato, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/191,144

(22) Filed: Feb. 26, 2014

(65) Prior Publication Data

US 2014/0239577 A1 Aug. 28, 2014

(30) Foreign Application Priority Data

Feb. 28, 2013 (JP) ..... 2013-038564

(51) Int. Cl.
*B65H 31/10* (2006.01)
*B65H 43/06* (2006.01)
*G03G 15/00* (2006.01)

(52) U.S. Cl.
CPC ..... *B65H 31/10* (2013.01); *B65H 43/06* (2013.01); *B65H 2405/15* (2013.01); (Continued)

(58) Field of Classification Search
CPC ..... B65H 31/08; B65H 31/10; B65H 31/12; B65H 31/20; B65H 2601/271; B65H 2515/10; B65H 2511/13; B65H 43/06
USPC ..... 271/213, 214, 215, 217
See application file for complete search history.

(56) References Cited

U.S. PATENT DOCUMENTS 6,318,718 B1 * 11/2001 Ogata et al. ..... 271/213
(Continued)

FOREIGN PATENT DOCUMENTS

JP 05116839 A 5/1993
(Continued)

OTHER PUBLICATIONS

Japanese Office Action dated Feb. 3, 2015, issued in counterpart Japanese Application No. 2013-038564.

*Primary Examiner* — Patrick Cicchino
(74) *Attorney, Agent, or Firm* — Holtz, Holtz, Goodman & Chick PC

(57) ABSTRACT

A paper sheet stacking apparatus includes: a stacking tray on which paper sheets are stacked; a driving section to drive the stacking tray in up and down directions corresponding to a height of the paper sheets stacked; a paper-sheet upper surface detecting section to detect an upper-most surface of the paper sheets to be stacked onto the stacking tray; a position detecting section to detect a position of the stacking tray by using a plurality of sensors respectively disposed at different positions arranged in a vertical direction, along which the stacking tray moves up and down; and a control section that determines whether or not the stacking tray is currently in a full loaded condition, based on the position of the stacking tray. By employing the information in regard to the weight and the thickness of each of the paper sheets, the control section selects any one of the sensors, provided in the position detecting section, as a full-loaded condition position sensor, and determines whether or not the stacking tray is currently in the full loaded condition, by using the full-loaded condition position sensor concerned.

18 Claims, 4 Drawing Sheets

(52) U.S. Cl.
CPC ..... *B65H 2511/10* (2013.01); *B65H 2511/13* (2013.01); *B65H 2511/152* (2013.01); *B65H 2511/20* (2013.01); *B65H 2511/30* (2013.01); *B65H 2515/10* (2013.01); *B65H 2515/112* (2013.01); *B65H 2601/271* (2013.01); *B65H 2801/06* (2013.01); *G03G 15/6552* (2013.01); *G03G 2215/00738* (2013.01); *G03G 2215/00911* (2013.01); *G03G 2215/00915* (2013.01)

(56) References Cited

U.S. PATENT DOCUMENTS

| | | | | |
|---|---|---|---|---|
| 6,986,511 | B2 * | 1/2006 | Yamada et al. | 271/294 |
| 8,262,086 | B2 * | 9/2012 | Kitazawa | 271/215 |
| 8,297,615 | B2 * | 10/2012 | Nakamura et al. | 271/214 |
| 8,585,046 | B2 * | 11/2013 | Herrmann et al. | 271/213 |
| 2004/0207152 | A1 * | 10/2004 | Watanabe et al. | 271/294 |
| 2006/0232002 | A1 * | 10/2006 | Watanabe et al. | 271/292 |
| 2010/0078878 | A1 * | 4/2010 | Nakamura et al. | 271/220 |

FOREIGN PATENT DOCUMENTS

| | | | |
|---|---|---|---|
| JP | 06016333 | A | 1/1994 |
| JP | 2007-015824 | A | 1/2007 |
| JP | 2009-249080 | A | 10/2009 |
| JP | 2011-121663 | A | 6/2011 |

* cited by examiner

PAPER SHEET STACKING APPARATUS, IMAGE FORMING APPARATUS, PAPER SHEET PROCESSING APPARATUS, IMAGE FORMING SYSTEM AND METHOD FOR CONTROLLING PAPER SHEET STACKING OPERATION

This application claims priority under 35 U.S.C. §119 to Japanese Patent Application No. 2013-038564 filed on Feb. 28, 2013, the entire disclosure of which is incorporated herein by reference in its entirety.

BACKGROUND OF THE INVENTION

1. Field of the Invention

The present invention relates to an image forming apparatus, a paper sheet processing apparatus or a paper sheet stacking apparatus that is coupled to an image forming system or the like, which is provided with an image forming apparatus and a paper sheet processing apparatus.

In addition, the present invention is further relates to a technology for controlling a paper sheet stacking operation, which makes it possible to appropriately manage a full loaded condition without generating an overloaded status caused by an overweight, with respect to various kinds of paper sheets, which are different from each other in weight and thickness thereof.

2. Description of Related Art

An image forming apparatus, such as a laser printer, a copier, etc., is provided with a stacking apparatus, which is disposed in the vicinity of an ejection opening so as to stack paper sheets ejected outside from the concerned apparatus, thereon. In the stacking apparatus above-mentioned, the stacking tray is configured to descend every time when each of the paper sheets is stacked onto the stacking tray, so that an upper surface of the bunch of paper sheets, currently stacked on the stacking tray, coincides with a predetermined position (height) of the ejecting section. Further, at the time when a part of the paper sheets, currently stacked on the stacking tray, is removed, the stacking tray is controlled to elevate, so that an upper surface of paper sheets, stacked on the stacking tray, coincides with a predetermined position of the ejecting section.

In the process of the consecutive actions above-mentioned, the descended position of the stacking tray is detected by sensors. Then, at the time when the stacking tray arrives at the predetermined descended position established in advance, it is determined that the stacking tray enters into the full loaded condition. Based on the above-mentioned determination in regard to the full loaded condition, the stacking tray is prevented from entering into the overloaded status caused by further stacking the paper sheets thereon.

With respect to the paper sheet stacking operation above-mentioned, each of Japanese Patent Application Laid-Open Publication 2011-121663, Japanese Patent Application Laid-Open Publication 2009-249080 and Japanese Patent Application Laid-Open Publication 2007-15824, sets forth various kinds of the related technologies.

In the paper sheet stacking apparatus as above-mentioned, at the time when a full-loaded conditional position sensor detects the fact that the stacking tray has descended to the lowest point, it is determined that a current status is the full loaded condition. In this connection, as the definition of the full loaded condition above-mentioned, the position of the full-loaded conditional position sensor is established at such a position that makes it possible to stack a predetermined number of paper sheets, acquired by back-calculating a stackable number of specific paper sheets from a total stackable weight of the specific paper sheets, a usage frequency of which is presumably the highest among other kinds of paper sheets. In a case where the usage frequency of normal paper sheets whose sizes are A4 size (hereinafter, each referred to as an A4 paper sheet or an A4 paper, further, in regard to other sizes, referred to as a B4 paper sheet, an A3 paper sheet, . . . , as well) is the highest, the full-loaded conditional position sensor is disposed at such a position that makes it possible to stack, for instance, 4000 sheets of A4 papers, acquired by back-calculating from a total weight of the paper sheets being stackable on the stacking tray concerned.

However, sometimes, paper sheets being larger than the A4 paper sheet, for instance, B4 paper sheets, A3 paper sheets, etc., or other paper sheets, a specific weight of each of which is greater than that of the A4 paper sheet, such as a pigment coated paper sheet or the like, may be employed. In this case, at the time when the full-loaded conditional position sensor detects the full loaded status, an actually loaded weight may exceed the total stackable weight of the specific paper sheets. For this reason, depending on a kind of paper sheets actually employed, sometimes, the stacking tray and/or the elevation driving mechanism may suffer from a large amount of loaded or driving burden. Conversely, in a case where paper sheets, each being smaller than the A4 paper sheet, are to be employed, the full-loaded conditional position sensor may detect the full loaded status even when an allowable room of the total stackable weight still remains. In other words, the system or the apparatus may enter into such a status that the allowable room of the total stackable weight still exists in vain.

According to Japanese Patent Application Laid-Open Publication 2011-121663 above-cited, the apparatus is provided with a reference height detecting section that detects the paper-sheet stacking height at the "reference height" located at a position being lower than the full loaded height of the ejecting tray. Then, after detecting the paper sheets stacked on the ejecting tray, the reference height detecting section accumulates the thickness values of the paper sheets, which are to be ejected newly as a group. Then, based on the accumulated value above-found, the full load processing is implemented.

Accordingly, since the reference height is detected from the paper sheet stacking height (or the stacking height of the group of paper sheets), and then, the residual height (number of paper sheets) is calculated from the reference height, it becomes possible to minimize the difference between the actual height of the group of paper sheets and the calculated value, resulting in improvements of preciseness and accuracy aspects. However, since the maximum weight to be loaded onto the ejecting tray is out of the considerations, it may be inevitable to enter into the overweight state caused by the overload, depending on the kind of paper sheets concerned. In other words, the aforementioned subject is not solved.

According to Japanese Patent Application Laid-Open Publication 2009-249080 above-cited, the apparatus is provided with a plurality of loaded condition detecting sections, so that, when any one of the loaded condition detecting sections detects the stacking device, the operation for determining whether or not the stacked paper sheets are in the full loaded condition is implemented. Further, it is proposed in the Patent Document above-cited that the above-mentioned determination should be made on the basis of a kind of the paper sheets. Accordingly, at the time when any one of the loaded condition detecting sections detects the stacking device, it is determined whether or not the stacked paper sheets are currently in the full loaded condition, based on the kind of the paper sheets concerned. Thanks to the above-mentioned, it becomes possible not only to prevent paper sheets, each having a relatively heavy weight, from being massively stacked onto the stacking device, but also, to prevent the paper sheets from being excessively stacked onto the stacking device. Accordingly, it becomes unnecessary to heighten the strength of the stacking device, and it also becomes unnecessary to increase the driving power for the descending mechanism, resulting in reduction of the manufacturing cost thereof.

However, according to the Patent Document above-cited, the sensor for detecting the full loaded condition is determined on the basis of the kind of the paper sheet. For this reason, the above-disclosed controlling operation is absolutely conducted on the basis of a subjective degree of a weight difference between normal paper sheets and relatively heavy paper sheets. As a result, the aforementioned subjects, at least one of which is to prevent the stacking tray from entering into the overweight condition and/or to stack paper sheets up to the maximum stackable weight with zero waste, cannot be solved.

For instance, even if it is possible to change the detecting device by considering the size difference between the kinds of paper sheets, such as that between an A4 paper sheet and a B4 paper sheet or the like, there exists no absolute criterion, though it is possible to cope with the above-mentioned operation for changing the detecting device by employing a relative criterion. Accordingly, in a case where there exists such an A4 paper sheet that is heavier than a B4 paper sheet, for instance, in a case where not only a normal paper sheet, but also a thin-and-heavy paper sheet, such as a pigment coated sheet, etc., are to be employed, or the like, there has arisen such a problem that it is impossible to appropriately cope with such the cases.

According to Japanese Patent Application Laid-Open Publication 2007-15824 above-cited, by making the ejecting tray move in both up and down directions, a moving velocity of the tray driving action, a moving time and an overweight of stacked paper sheets measured by the weight scale device, are detected in conjunction with the above up-and-down moving actions. Then, it is proposed that, when the overweight status of stacked paper sheets is detected and it is determined that the weight of paper sheets, currently stacked on the ejecting tray concerned, reaches the predetermined allowable value, the stacking action is made to stop.

According to the consecutive operations above-mentioned, since the control device determines the weight status of the paper sheets, currently stacked on the ejecting tray concerned, it is possible to control the loading condition of the driving section in the process of moving the paper sheet stacking section in the up and down directions, more accurately than in the case of determining the stacking height of the paper sheets concerned. Further, even when an error of measuring the paper-sheet stacking height is great, it is possible to accurately determine the loading condition of the driving section so as to make it possible to control the stacking amount of paper sheets.

However, in order to determine the stacking weight from the moving velocity and/or the moving time in midcourse of elevating and descending operations, it is necessary to repeatedly conduct elevating and descending actions for a predetermined moving distance (for instance, 40 mm), every time when a predetermined number of paper sheets (for instance, 5 paper sheets) are ejected. This kind of repeated operation of elevating and descending actions may adversely affect the overall operations of the apparatus from a power consumption, sound noise and a durability points of view.

Further, it may be considered such a measure that a number of paper sheets to be ejected are counted, and then, a weight of paper sheets, currently stacked, is calculated by accumulating the number of the paper sheets and the weight of the paper sheets so as to stack the paper sheets within the range of the maximum stackable weight. However, in case that some paper sheets are removed from the stacking section in midcourse of implementing the stacking operation, it is impossible to count the number of removed paper sheets. For this reason, the control section may erroneously determine, from the calculation result above-mentioned, that the weight of paper sheets, currently stacked on the ejecting tray concerned, reaches the maximum stackable weight at the time when the weight of paper sheets does not actually reach the maximum stackable weight. Then, owing to the determination error above-mentioned, the stacking operation may be made to stop in a state of still remaining a room for stacking more number of paper sheets.

SUMMARY OF THE INVENTION

According to a paper sheet stacking apparatus reflecting an aspect of the present invention, the paper sheet stacking apparatus that stacks paper sheets, each of which is ejected outside after an image has been formed thereon and/or a paper sheet processing has been applied thereto, comprises: a stacking tray to stack the paper sheets, onto each of which an image is formed and/or a paper sheet processing is applied, thereon; an up-and-down driving section to drive the stacking tray in up and down directions corresponding to a height of the paper sheets stacked; a paper-sheet upper surface detecting section to detect an upper-most surface of the paper sheets to be stacked onto the stacking tray; a position detecting section to detect a position of the stacking tray by using a plurality of sensors respectively disposed at different positions arranged in a vertical direction, along which the stacking tray moves up and down; and a control section that controls the up-and-down driving section to drive the stacking tray so as to keep a position of the upper-most surface of the paper sheets, which is to be detected by the paper-sheet upper surface detecting section, constant, and determines whether or not the stacking tray is currently in a full loaded condition, based on the position of the stacking tray, detected by the position detecting section;

wherein, by employing information in regard to a weight and a thickness of each of the paper sheets, the control section selects any one of the plurality of sensors as a full-loaded condition position sensor that indicates the full loaded condition of the stacking tray, and determines whether or not the stacking tray is currently in the full loaded condition, based on the position of the stacking tray, which is detected by the full-loaded condition position sensor concerned.

Further, according to another aspect of the present invention, in the paper sheet stacking apparatus above-recited, the control section calculates the thickness of each of the paper sheets, based on a number of the paper sheets stacked onto the stacking tray and a position of any one of the plurality of sensors provided in the position detecting section.

Still further, according to still another aspect of the present invention, in the paper sheet stacking apparatus above-recited, by employing the information in regard to the weight and the thickness of each of the paper sheets, the control section selects a sensor, which is disposed at such a position at which the stacking tray enters into an overweight condition, as an overweight position sensor among the plurality of sensors provided in the position detecting section, and further selects another sensor, which is disposed at a one-stage upper position from the overweight position sensor, as a full-loaded condition position sensor among the plurality of sensors.

Still further, according to still another aspect of the present invention, in the paper sheet stacking apparatus above-recited, it is desirable that the control section finds a differential weight, defined as a difference between the weight of the paper sheets, stacked on the stacking tray currently positioned at the full-loaded condition position sensor, and a maximum stackable weight of the stacking tray, and then, finds a "differential-weight equivalent number of paper sheets", defined as a number of the paper sheets equivalent to the differential weight; and at a time when the position of the stacking tray, currently descending, is detected by the full-loaded condition position sensor, the control section starts to count a number of paper sheets stacked, and then, at another time when the number of the paper sheets stacked reaches the "differential-weight equivalent number of paper sheets", the control section determines that the stacking tray has entered into the full-loaded condition.

Still further, according to still another aspect of the present invention, in the paper sheet stacking apparatus above-recited, it is desirable that, in midcourse of a counting operation for counting the number of the paper sheets stacked from the time when the position of the stacking tray is detected by the full-loaded condition position sensor, in case where it is detected that the stacking tray elevates up to such a position that is higher than that of the full-loaded condition position sensor, the control section resets a current value above-counted, and then, resumes the counting operation at the time when the position of the stacking tray, currently descending, is detected by the full-loaded condition position sensor; and after resuming the counting operation, at the other time when the number of the paper sheets stacked reaches the "differential-weight equivalent number of paper sheets", the control section determines that the stacking tray has entered into the full-loaded condition.

Still further, according to an image forming apparatus reflecting still another aspect of the present invention, the image forming apparatus comprises: an image forming section to form an image on a paper sheet; an ejecting section to eject the paper sheet on which the image is formed; and the paper sheet stacking apparatus that stacks the paper sheet, ejected by the ejecting section, onto the stacking tray, as above-mentioned.

Still further, according to a paper sheet processing apparatus reflecting still another aspect of the present invention, the paper sheet processing apparatus comprises: a paper sheet processing section to apply a paper sheet processing to a paper sheet; an ejecting section to eject the paper sheet to which the paper sheet processing is applied; and the paper sheet stacking apparatus that stacks the paper sheet, ejected by the ejecting section, onto the stacking tray, as above-mentioned.

Still further, according to an image forming system reflecting still another aspect of the present invention, the image forming system, comprises: an image forming section to form an image on a paper sheet; a paper sheet processing section to apply a paper sheet processing to the paper sheet on which the image is formed; an ejecting section to eject the paper sheet to which paper sheet processing is applied; and the paper sheet stacking apparatus that stacks the paper sheet, ejected by the ejecting section, onto the stacking tray, as above-mentioned.

Yet further, according to a method for controlling a paper sheet stacking operation, reflecting yet another aspect of the present invention, it is desirable that, in the paper sheet stacking apparatus above-mentioned, the method comprises: selecting any one of the plurality of sensors as a full-loaded condition position sensor that indicates the full loaded condition of the stacking tray, by employing information in regard to a weight and a thickness of each of the paper sheets; and determining whether or not the stacking tray is currently in the full loaded condition, based on the position of the stacking tray, which is detected by the full-loaded condition position sensor concerned.

DETAILED DESCRIPTION OF THE PREFERRED EMBODIMENT

Figure 1:
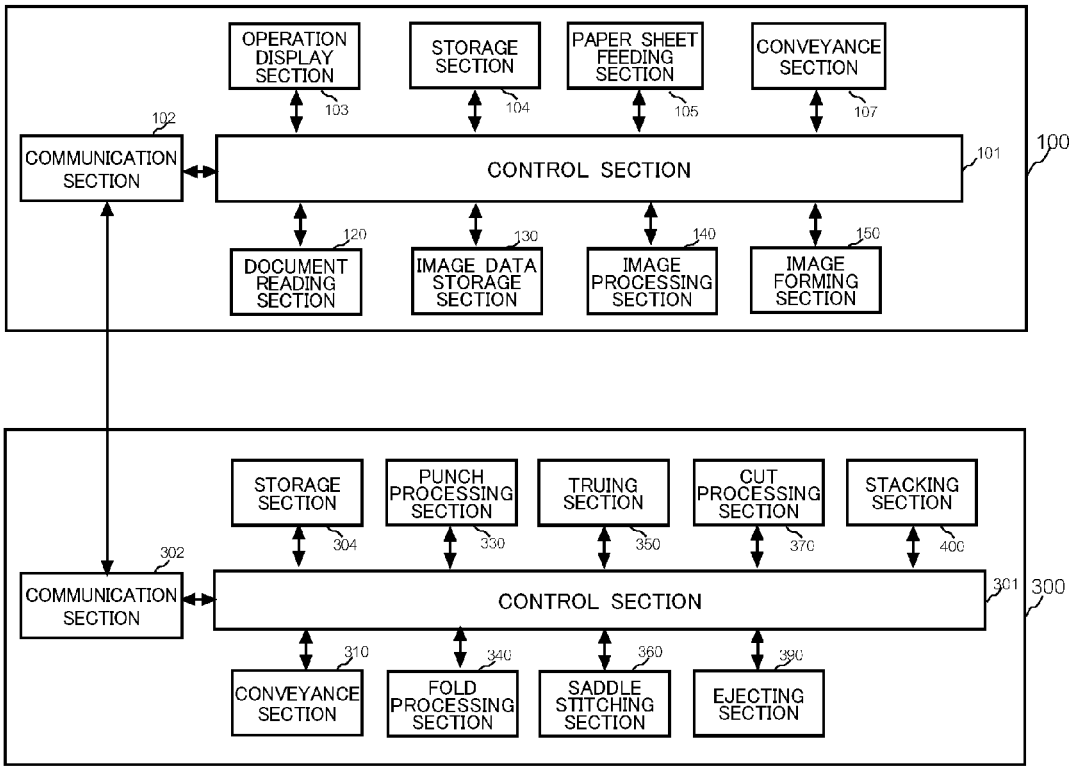
FIG. 1 is a block diagram showing a configuration of an image forming system in accordance with an embodiment of the present invention.

In the following paragraphs, one or more embodiments of the invention will be described by way of example and not limitation. It should be understood based on this disclosure that various other modifications can be made by those in the art based on these illustrated embodiments. Referring to the drawings, an embodiment for implementing the present invention (hereinafter, referred to as an embodiment) will be detailed in the following.

<Overall Configuration>

Figure 2:
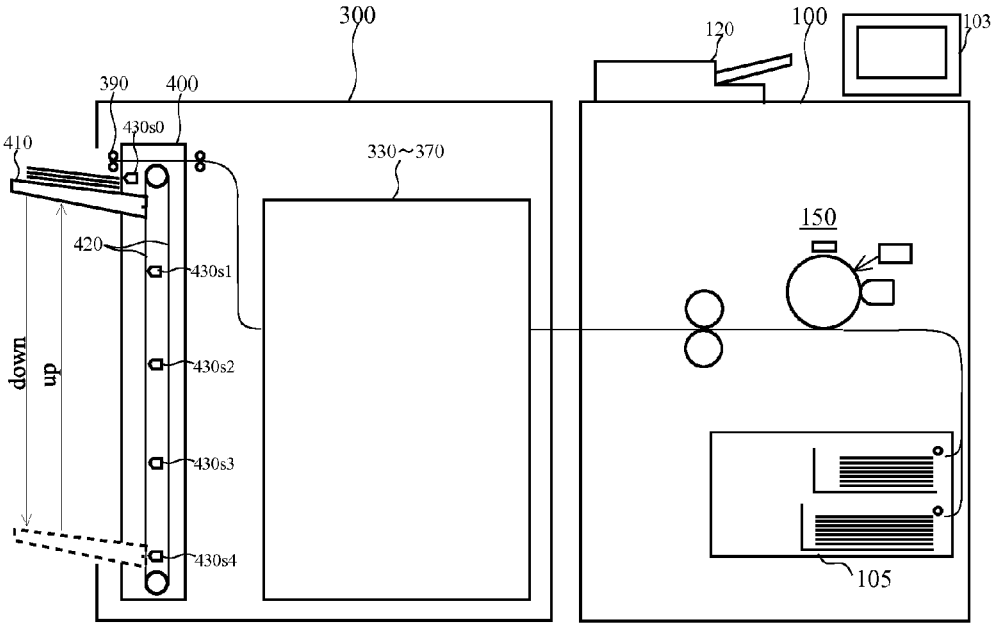
FIG. 2 is a schematic diagram showing a configuration of an image forming system in accordance with an embodiment of the present invention.

Now, referring to the schematic diagrams shown in FIG. 1 and FIG. 2, a paper sheet stacking apparatus, an image forming apparatus provided with a paper sheet stacking apparatus, a paper sheet processing apparatus provided with a paper sheet stacking apparatus, an image forming system provided with a paper sheet stacking apparatus and a method for controlling a paper sheet stacking operation to be performed in a paper sheet stacking apparatus, each of which is in accordance with the embodiment of the present invention, will be detailed in the following.

Concretely speaking, as indicated in the schematic diagrams shown in FIG. 1 and FIG. 2, the image forming system is provided with: an image forming apparatus 100 that forms an image onto a paper sheet; and a paper sheet processing apparatus 300 that serves as a successive stage of the image forming apparatus 100 and has a paper sheet processing function. Further, the paper sheet processing apparatus 300 is provided with a paper sheet stacking apparatus serving as a stacking section.

In this connection, the arrangement of the above-mentioned connections between the apparatuses, indicated in the image forming system, is illustrative only, and the scope of the present invention is not limited to the connecting mode above-indicated.

The image forming apparatus 100 is constituted by a control section 101, a communication section 102, an operation display section 103, a storage section 104, a paper sheet feeding section 105, a conveyance section 107, a document reading section 120, an image data storage section 130, an image processing section 140 and an image forming section 150. In this connection, the paper sheet, onto which an image is formed in the image forming apparatus 100, is conveyed outside towards the paper sheet processing apparatus 300.

In the structural configuration above-mentioned, the control section 101 controls each of the sections provided in the image forming apparatus 100, and at the same time, controls overall operations in the system serving as the paper sheet processing apparatus. The communication section 102 implements operations for communicating with other apparatuses coupled thereto. The operation display section 103 notifies the control section 101 of the operation inputting signals generated corresponding to the inputting operations performed thereon by the operator, and at the same time, displays the current statuses of the image forming apparatus 100. The storage section 104 stores various kinds of controlling programs and various kinds of setting data, and is used as the working area for executing the controlling programs. The paper sheet feeding section 105 feeds the paper sheets accommodated therein. The conveyance section 107 conveys the paper sheet, fed from the paper sheet feeding section 105 and to be employed for an image forming operation, at a predetermined velocity. The document reading section 120 scans the document so as to generate image data thereof. The image data storage section 130 stores the image data to be employed for the image forming operation and various kinds of data. The image processing section 140 implements various kinds of image processing necessary for the image forming operation. The image forming section 150 implements a printing operation (hereinafter, referred to as an "image forming operation") based on the image forming command and the processed image data created by applying the image processing to the image data.

The paper sheet processing apparatus 300 is coupled to the image forming apparatus 100 as the successive stage thereof, and constituted by a control section 301, a communication section 302, a storage section 304, a conveyance section 310, a punch processing section 330, a fold processing section 340, the truing section 350, a saddle stitching section 360, a cut processing section 370, an ejecting section 390 and a stacking section 400.

In the configuration above-mentioned, the control section 301 controls each of the sections provided in the paper sheet processing apparatus 300. The communication section 302 communicates with the image forming apparatus 100. The storage section 304 stores various kinds of controlling programs and various kinds of setting data, and is used as the working area for executing the controlling programs. The conveyance section 310 conveys the paper sheet at a predetermined velocity. The punch processing section 330 bores a binding hole onto the paper sheet. The fold processing section 340 applies the center fold processing to the paper sheet or folds the paper sheet three. The truing section 350 trues a plurality of paper sheets folded. The saddle stitching section 360 binds the bunch of paper sheets folded and trued. The cut processing section 370 cuts the edge portion of the bunch of paper sheets saddle-stitched. The ejecting section 390 ejects the paper sheets outside. The stacking section 400 stacks the ejected paper sheet onto the stacking tray, which is movable in both up and down directions.

As indicated in the schematic diagram shown in FIG. 2, the stacking section 400 is constituted by a stacking tray 410, an up-and-down driving section 420, a sensor **430*s*0, and a plurality of sensors 430*s*1 through 430*s*4**.

In the configuration above-mentioned, the stacking tray 410 stacks the paper sheet, ejected by the ejecting section 390, thereon. The up-and-down driving section 420 drives the stacking tray 410 to move in the up and down directions, corresponding to an amount of paper sheets currently stacked on the stacking tray 410. The sensor **430*s*0 serves as a paper-sheet upper surface detecting section that detects an uppermost surface of the paper sheets currently stacked on the stacking tray 410. The plurality of sensors 430*s*1 through 430*s*4 are respectively disposed at different positions in the up-and-down moving direction of the stacking tray 410 so as to serve as a position detecting section that detects a current position of the stacking tray 410**.

Then, the stacking section 400 is controlled in such a manner that the up-and-down driving section 420 is driven to move in the up and down directions (indicated by the arrow "up" or "down" in the schematic diagram shown in FIG. 2). According to this controlling action, the position of the uppermost surface of the paper sheets currently stacked on the stacking tray 410, which is detected by the sensor **430*s*0**, is controlled to be kept at a constant position.

In this connection, the arrangement and the number of the sensors **430*s*1 through 430*s*4, serving as the position detecting section that detects a current position of the stacking tray 410, are illustrative only. The scope of the present invention is not limited to the concrete example above-illustrated. Further, it is also applicable that the paper sheet processing apparatus 300 is so constituted that the stacking tray 410** serves as a main tray, and a sub-tray (not shown in the drawings) is further provided therein.

Further, although the stacking section 400 is included in the paper sheet processing apparatus 300 according to the explanations described in the foregoing, it is also applicable that an independent stacking apparatus 400, which serves as the stacking section 400, is coupled to the paper sheet processing apparatus 300 as an independent successive stage thereof.

Still further, although the stacking section 400 is included in the paper sheet processing apparatus 300, the scope of the present invention is not limited thereto. For instance, in a case where the paper sheet processing apparatus 300 is not employed, the stacking section 400 may be included in the image forming apparatus 100. As well as the above, in a case where the paper sheet processing apparatus 300 is not employed, a paper sheet stacking section 400, instead of the stacking section 400, may be coupled to the image forming apparatus 100 as a successive stage thereof.

In the following, the present embodiment will be detailed by employing the concrete example indicated as follows. In the first state that the stacking tray 410 of the stacking section 400 resides at such a position that is to be detected by the sensor **430*s*1, the first height (equal to a distance D1 between the sensor 430*s*0 and the sensor 430*s*1) makes it possible to stack 1000 sheets of normal papers thereon. In the second state that the stacking tray 410 of the stacking section 400 resides at such a position that is to be detected by the sensor 430*s*2, the second height (equal to a distance D2 between the sensor 430*s*0 and the sensor 430*s*2) makes it possible to stack 2000 sheets of normal papers thereon. In the third state that the stacking tray 410 of the stacking section 400 resides at such a position that is to be detected by the sensor 430*s*3, the third height (equal to a distance D3 between the sensor 430*s*0 and the sensor 430*s*3) makes it possible to stack 3000 sheets of normal papers thereon. In the fourth state that the stacking tray 410 of the stacking section 400 resides at such a position that is to be detected by the sensor 430*s*4, the fourth height (equal to a distance D4 between the sensor 430*s*0 and the sensor 430*s*4**) makes it possible to stack 4000 sheets of normal papers thereon.

In this connection, on the premise that the thickness of each of the normal paper sheets is assumed as 0.1 mm, the concrete example of the present embodiment can be described as follows. The distance D1 between the sensor 430*s*0 and the sensor 430*s*1, which makes it possible to stack 1000 sheets of normal papers on the stacking tray 410, is 100 mm. The distance D2 between the sensor 430*s*0 and the sensor 430*s*2, which makes it possible to stack 2000 sheets of normal papers on the stacking tray 410, is 200 mm. The distance D3 between the sensor 430*s*0 and the sensor 430*s*3, which makes it possible to stack 3000 sheets of normal papers on the stacking tray 410, is 300 mm. The distance D4 between the sensor 430*s*0 and the sensor 430*s*4, which makes it possible to stack 4000 sheets of normal papers on the stacking tray 410, is 400 mm.

Further, in addition to the purpose of detecting the 1000 sheets of normal papers, it is possible to doubly employ the sensor 430*s*1 for any one of the other purposes indicated as follows. Various kinds of sensors to be employed for the doubly-usable purposes include: a sensor for preventing a load shifting of small-sized paper sheets stacked; a near-empty detection sensor for detecting a decrease of the residual amount of the paper sheets; a paper-sheet taking out detection sensor for detecting an event of taking out the paper sheet from the tray; and a folding paper-sheet full-load detection sensor for detecting a full load status of the paper sheets to be folded. In this connection, in the present embodiment, as detailed later, the sensor 430*s*1 is employed not only as the detecting sensor for detecting 1000 sheets of normal papers, but also as a reference sensor for measuring the thickness of the paper sheet Incidentally, in the present embodiment, the stacking section 400 is provided with at least a reference sensor (herein, the sensor 430*s*1) and at least two sensors for detecting the full load (herein, the sensors 430*s*2 through 430*s*4).

Further, the stacking tray 410 or the up-and-down driving section 420 is structured, based on the premise that a weight of "Z" gram, at the time when the A4 normal paper sheets are fully loaded, is defined as the maximum stackable weight. In the present embodiment, the weight of "Z" gram, which is equal to that of 4000 sheets of A4 normal papers, is the maximum stackable weight.

For instance, it is assumed such a case that 4000 sheets of A4 normal papers, each of which has a basis weight of 80 gsm (gram per square meter), are stacked up to the position of the sensor 430*s*4 (distance D4). In this case, the weight "Z" of a single sheet of the A4 normal paper is found as follow.

$$Z=(80\text{ gram}/(1000\text{ mm}\times100\text{ mm}))\times(297\text{ mm}\times210\text{ mm})=5\text{ gram}$$

Accordingly, 5 gram×400 sheets=20 kg is found as the estimated maximum stackable weight "Z" gram. Incidentally, in the present embodiment, the unit of the basis weight is represented as "gms" (gram per square meter).

Further, when the maximum stackable weight, being the same as above-mentioned, is assumed, 3000 sheets of B4 normal papers, each of which has a basis weight of 80 gsm (gram per square meter), are stacked up to the position of the sensor 430*s*3 (distance D3), or 2000 sheets of A3 normal papers, each of which has a basis weight of 80 gsm (gram per square meter), are stacked up to the position of the sensor 430*s*2 (distance D2). In the above case, since 20 kg is found as the weight of the paper sheets concerned, it is determined as stackable.

However, in regard to such a special paper sheet as a pigment coated paper sheet that has a basis weight being greater than that of a normal paper even though its thickness is the same as that of the normal paper sheet, or, such another special paper sheet that is thin but heavy, or the like, the weight of such the special paper sheets stacked may possibly exceed the maximum stackable weight "Z" gram estimated for the normal paper sheets as above-mentioned. Accordingly, it is necessary to implement the controlling operations detailed later.

<Operations of Embodiment>

Referring to the flowchart shown in FIG. 3 and the operation explanatory schematic diagrams shown in FIG. 4 through FIG. 7, the image forming apparatus 100, the paper sheet processing apparatus 300, the image forming system including the stacking section 400 and the method for controlling the paper sheet stacking operations, each of which is in accordance with the embodiment of the present invention, will be detailed in the following. Hereinafter, explanations will be given in regard to such the concrete example in which the control section 301, provided in the paper sheet processing apparatus 300, controls the paper sheet stacking operation as a whole.

Figure 3:
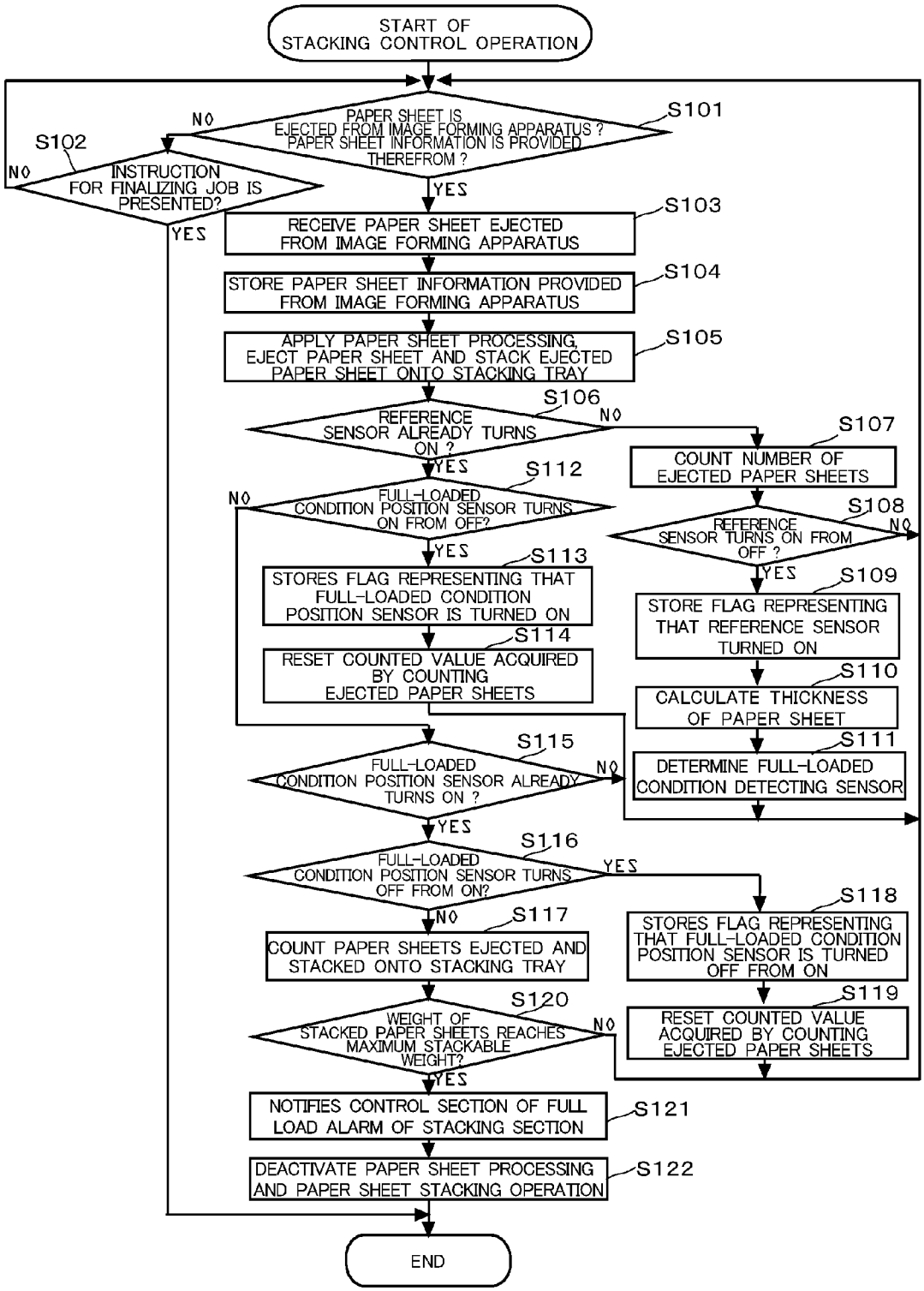
FIG. 3 is a flowchart showing a flow of processing for controlling a paper sheet stacking operation in accordance with an embodiment of the present invention.
Figure 4:
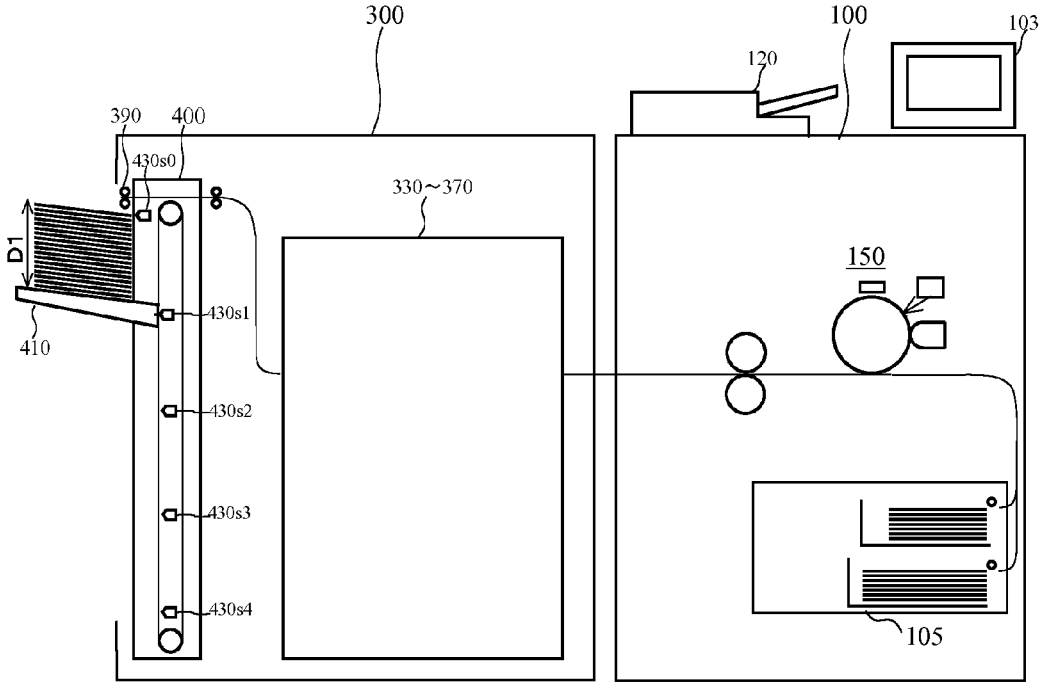
FIG. 4 is a schematic diagram showing a configuration and an operating status of an image forming system in accordance with an embodiment of the present invention.
Figure 5:
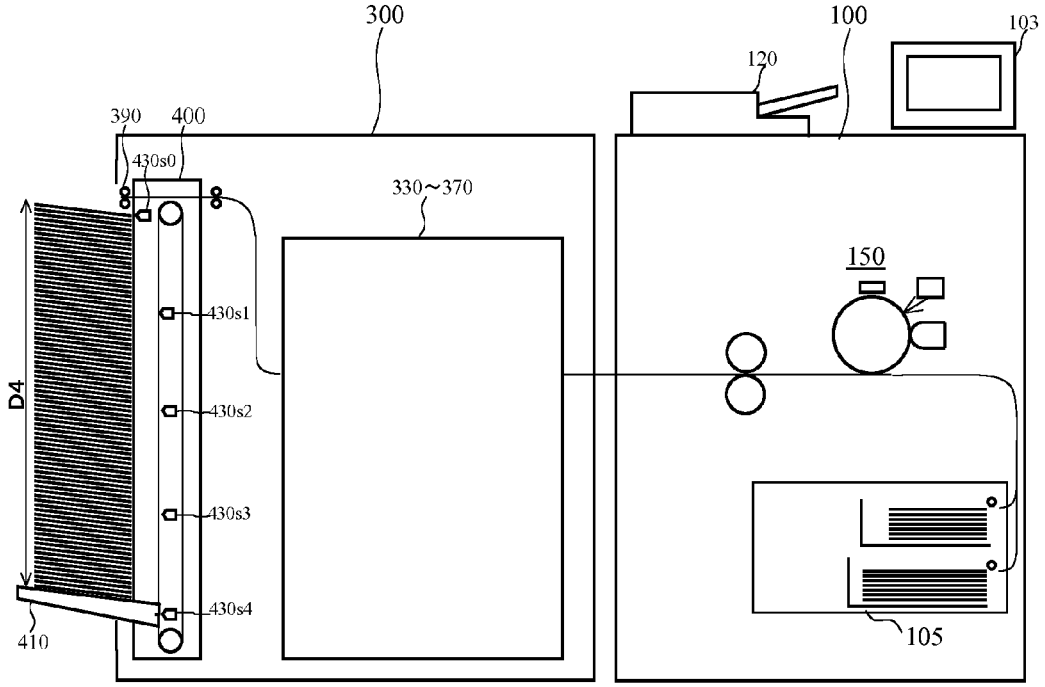
FIG. 5 is a schematic diagram showing a configuration and an operating status of an image forming system in accordance with an embodiment of the present invention.
Figure 6:
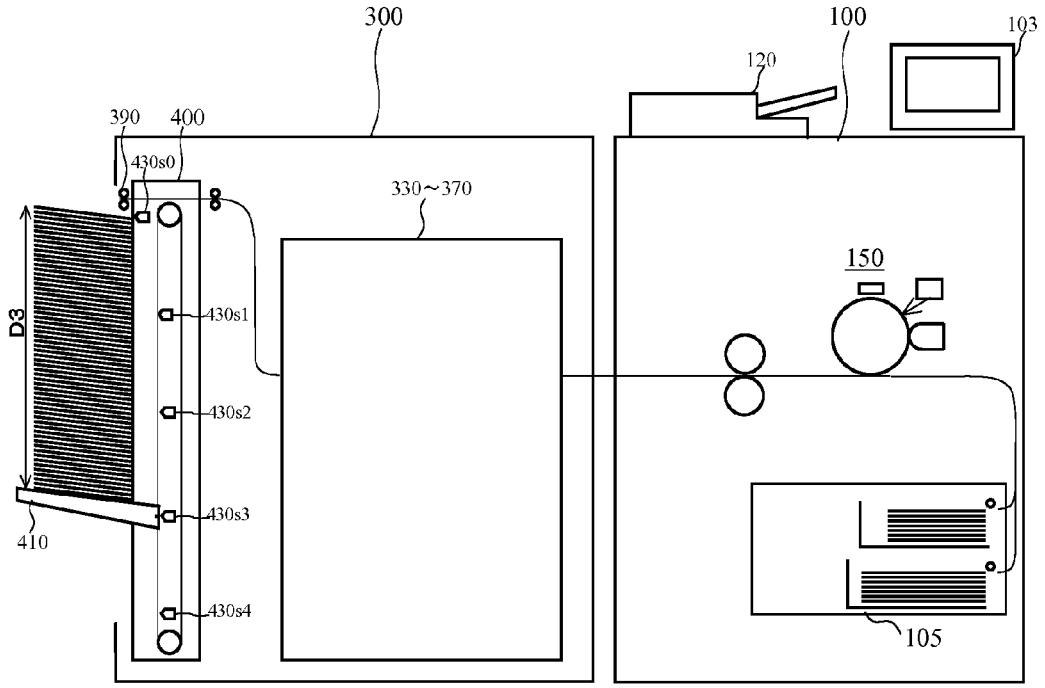
FIG. 6 is a schematic diagram showing a configuration and an operating status of an image forming system in accordance with an embodiment of the present invention.
Figure 7:
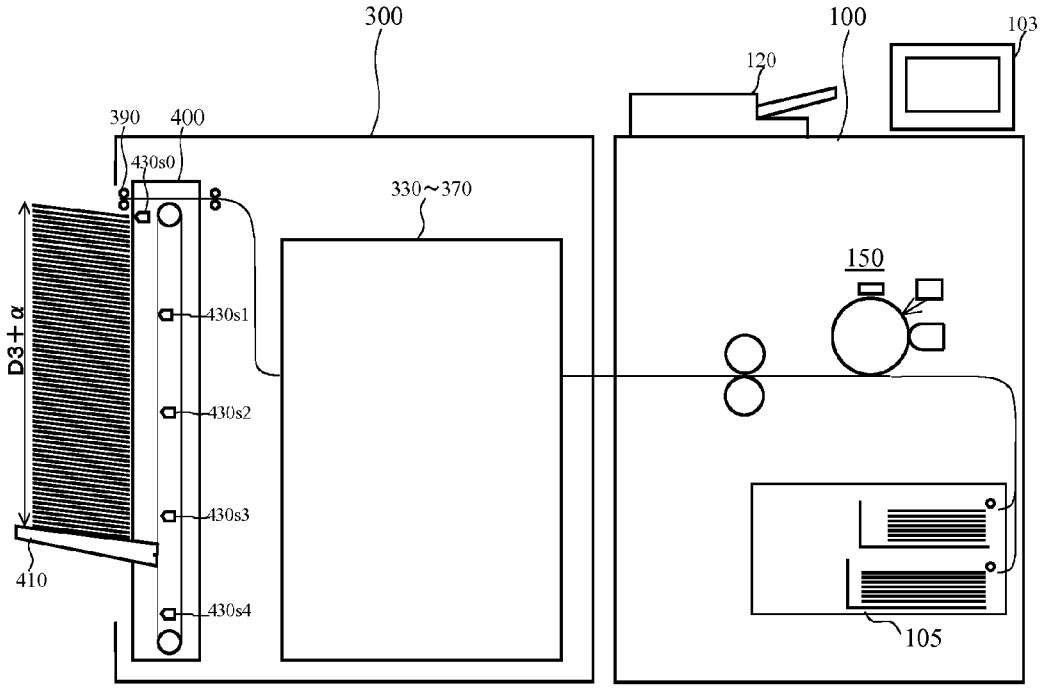
FIG. 7 is a schematic diagram showing a configuration and an operating status of an image forming system in accordance with an embodiment of the present invention.

Initially, receiving an instruction for commencing a job defined as a unity of consecutive image forming operations, the control section 301 commences the operation for controlling the paper sheet stacking operations (START, shown in FIG. 3). At this time, the control section 301 confirms whether or not a paper sheet is ejected from the image forming apparatus 100 and further confirms whether or not paper sheet information (information in regard to what kind of paper sheet processing is to be applied to what kind of paper sheet) is provided therefrom (Step S101, shown in FIG. 3). Then, when confirming that the paper sheet is not ejected from the image forming apparatus 100 and the paper sheet information is not provided therefrom (Step S101; NO, shown in FIG. 3), the control section 301 confirms whether or not an instruction for finalizing the job concerned is presented (Step S102, shown in FIG. 3).

Successively, when determining that the instruction for finalizing the job concerned is presented (Step S102; YES, shown in FIG. 3), the control section 301 finalizes the paper sheet stacking operations (END, shown in FIG. 3).

On the other hand, when determining that the instruction for finalizing the job concerned is not presented (Step S102; NO, shown in FIG. 3), the control section 301 waits the paper sheet ejected from the image forming apparatus 100 and the arrival of the paper sheet information therefrom (Step S101, shown in FIG. 3).

When confirming that the paper sheet is ejected from the image forming apparatus 100 and the paper sheet information is provided therefrom (Step S101; YES, shown in FIG. 3), the control section 301 controls the conveyance section 310 so as to receive the paper sheet ejected from the image forming apparatus 100 (Step S103, shown in FIG. 3). Further, the control section 301 makes the storage section 304 store the paper sheet information, provided from the image forming apparatus 100, therein (Step S104, shown in FIG. 3). In this connection, the above-mentioned paper sheet information includes: paper sheet size information, such as an A4 size, a B4 size, etc.; paper-sheet basis weight information, such as 80 gsm, etc.; paper-sheet processing information representing what kind of processing is to be applied to the paper sheet concerned; etc.

Still successively, the control section 301 controls at least one of the paper sheet processing sections (including the punch processing section 330, the fold processing section 340, the truing section 350, the saddle stitching section 360, the cut processing section 370, etc.) so as to apply the paper sheet processing, instructed by the image forming apparatus 100, to the paper sheet ejected therefrom. Further, the control section 301 controls the stacking section 400 so as to stack the ejected paper sheet onto the stacking tray 410 (Step S105, shown in FIG. 3).

On this occasion, the control section 301 controls the up-and-down driving section 420 to make the stacking tray 410 descend in accordance with the paper sheet stacking action, so as to make it possible for the sensor 430s0, serving as the paper-sheet upper-surface detecting section, to always detect the upper surface of the paper sheet. Accordingly, the stacking tray 410 descends from the position indicated in the schematic diagram shown in FIG. 2 towards the other positions indicated in the schematic diagrams shown in FIG. 4 and FIG. 5, so as to continue the operation for stacking the paper sheet thereon. In this connection, the schematic diagram shown in FIG. 5 indicates such a state that the stacking tray 410 has descended at the lowest position. However, depending on the controlling action detailed later, the stacking tray 410 may stop short of the lowest position above-mentioned, due to the detected result that the stacking tray 410 has entered into the full loaded condition.

Still successively, the control section 301 monitors the result detected by the sensor 430s1, serving as the reference sensor (Step S106). Unless the sensor 430s1, serving as the reference sensor, has already turned ON (in other words, unless the stacking tray 410 can be detected by the sensor 430s1) (Step S106; NO, shown in FIG. 3), the control section 301 counts the number of paper sheets ejected from the ejecting section 390 onto the stacking tray 410 (Step S107, shown in FIG. 3).

Still successively, the control section 301 continues to count the number of the ejected paper sheets (Step S107, shown in FIG. 3), until the sensor 430s1 turns ON (Step S108; NO, Steps S101 through S107, shown in FIG. 3).

Still successively, when the sensor 430s1 turns ON (in other words, in such a state that the stacking tray 410 can be detected by the sensor 430s1 (refer to the schematic diagram shown in FIG. 4)) (Step S108; YES, shown in FIG. 3), the control section 301 stores a flag of "Base_sensor_on=1" or the like, which represents the ON status of the sensor 430s1, therein (Step S109, shown in FIG. 3). Then, referring to the counted value "C" (number of paper sheets ejected and stacked until the sensor 430s1 turns ON) and the distance D1 (distance between the sensor 430s0 and the sensor 430s1), the control section 301 calculates the thickness "d" of the paper sheet by employing the equation of "d"="D1"/"C" (Step S110, shown in FIG. 3).

For instance, in a case of distance "D1"=100 mm and counted value "C"=1250, the thickness "d" of the paper sheet can be calculated as "d"=100/1250=0.08 mm.

In this connection, based on the above-calculated thickness "d" of the paper sheet and the weight "z" of the paper sheet concerned, the control section 301 determines any one of the sensors 430s2 through 430s4 as the full-loaded condition detecting sensor for deciding the full loaded condition of the stacking tray 410 (Step S111, shown in FIG. 3).

Herein, referring to the paper-sheet basis weight information, the control section 301 calculates the weight "z" per a single paper sheet corresponding to the size of the paper sheet. In this connection, since the basis weight is defined as a nominal weight of a paper sheet having an area of 1 square meters, it is possible to calculate the weight "z" of the paper sheet, by multiplying the basis weight by the actual area of the paper sheet concerned.

Accordingly, since the stackable number of paper sheets at the position of each of sensors 430sx ("x" represents any one of integers 2 through 4) is found by "Dx/d", the weight of paper sheets stackable at the position of each of sensors 430sx can be calculated by multiplying the value of "Dx/d" by the weight "z" of the paper sheet.

In other words, the weight of paper sheets stackable at the position of the sensor 430s2 is equal to "(D2/d)×z", the weight of paper sheets stackable at the position of the sensor 430s3 is equal to "(D3/d)×z", and the weight of paper sheets stackable at the position of the sensor 430s4 is equal to "(D4/d)×z".

In this connection, the control section 301 compares each of the values of "(D2/d)×z", "(D3/d)×z" and "(D4/d)×z" with the maximum stackable weight "Z" aforementioned, and determines one of the sensors 430sx, at which the stacked paper sheets becomes the maximum stackable amount within the non-overweight range, as the full loaded condition position sensor (Step S111, shown in FIG. 3).

Concretely speaking, the stacking tray 410 selects one of the sensors, which is located at such a position from which the weight of the stacked paper sheets enters into an overweight condition, as an overweight position sensor, and then, further selects another sensor, which is located at one-stage upper position relative to the overweight position sensor above-selected, as a full-loaded condition position sensor. According to the method above-mentioned, with respect to various kinds of paper sheets, which are different from each other in weight and thickness thereof, it is possible to securely prevent the stacking tray from being overloaded by the paper sheets. In addition, it becomes possible to control the full loaded condition appropriately.

In this connection, since the amount of the paper sheets to be stacked on the stacking tray 410 is made to reduce by selecting the "sensor located at one-stage upper position", it becomes possible to eliminate the overweight condition.

Still successively, the control section 301 controls each of the sections concerned, so as to repeat the consecutive operations for applying the paper sheet processing, ejecting and stacking the paper sheet. Then, when determining that the sensor 430s1 turns ON (Base_sensor_on=1) (Step S106; YES, shown in FIG. 3), the control section 301 further determines whether or not the stacking tray 410 has arrived at the position of the full-loaded condition position sensor (Step S112, shown in FIG. 3).

Unless the stacking tray 410 arrives at the position of the full-loaded condition position sensor, the output status of the full-loaded condition position sensor is kept OFF (Step S112; NO, Step S115; NO, shown in FIG. 3). Accordingly, the control section 301 repeats the consecutive processing indicated in Step S101 through Step S112 aforementioned.

When the stacking tray 410 arrives at the position of the full-loaded condition position sensor, the output status of the full-loaded condition position sensor is turned ON from OFF (Step S112; NO, Step S112; NO, shown in FIG. 3). In this connection, the control section 301 stores a flag of "Full_sensor_on=1" or the like, which represents the fact that the full-loaded condition position sensor is turned ON from OFF, therein (Step S113, shown in FIG. 3). At this time, the control section 301 resets the counted value "C" acquired by counting the paper sheets ejected onto the stacking tray 410 (Step S114, shown in FIG. 3).

Still successively, when determining that the full-loaded condition position sensor has turned ON (Full_sensor_on=1) (Step S112; NO, Step S115; YES, Step S116; NO, shown in FIG. 3), the control section 301 continue to stack the paper sheets onto the stacking tray 410, and also continue to count the paper sheets stacked (Step S117, shown in FIG. 3).

Concretely speaking, at the time when the full-loaded condition position sensor turns ON, an amount of the paper sheets, currently stacked on the stacking tray 410, is still in such a state that the current weight status thereof does not enter into the overweight condition. In other words, there still remains same room for further stacking additional paper sheets, until the current weight reaches the overweight condition. Accordingly, the control section 301 continues to stack the paper sheets so as to fulfill the remaining room.

For instance, it is assumed that, in order not to enter into the overweight condition, the control section 301 selects the sensor 430*s*3 as the full-loaded condition position sensor in Step S111 above-mentioned. In this case, further assuming that the maximum stackable weight "Z"=20 kg and "(D3/d)×z"=(300/0.08)×5=18.75 kg, an allowance (differential weight) of 1.25 kg has been generated. Accordingly, if the paper sheets, each of which has a weight of 5 grams, are employed, it is still possible to stack 250 (=1250/5) sheets of papers, which is equal to a "differential-weight equivalent number of paper sheets", since the full-loaded condition position sensor has turned ON.

In this connection, the term of "differential weight" is defined as such a weight that is equivalent to the difference between a total weight of paper sheets, which are currently stacked on the stacking tray 410 located at a position of the full-loaded condition position sensor, and the maximum stackable weight of the stacking tray 410. Further, the term of "differential-weight equivalent number of paper sheets" is defined as such a number of paper sheets that is equivalent to the "differential weight" above-defined.

Concretely speaking, at the time when counting 250 sheets of papers stacked onto the stacking tray 410 (refer to the schematic diagram shown in FIG. 7) since the full-loaded condition position sensor has turned ON (refer to the schematic diagram shown in FIG. 6) (Step S117, shown in FIG. 3), the control section 301 determines that the weight of the stacked paper sheets reaches the maximum stackable weight "Z" (Step S120; YES, shown in FIG. 3). At this time, the control section 301 notifies the control section 101, provided in the image forming apparatus 100, of a full load alarm representing that the stacking section 400 just enters into the full loaded condition (Step S121, shown in FIG. 3). Then, under the communication with the control section 101, the control section 301 deactivates the paper sheet processing and the paper sheet stacking operation (Step S122, shown in FIG. 3).

As described in the foregoing, the differential weight, defined as the weight equivalent to the difference between the total weight of paper sheets currently stacked on the stacking tray 410 located at the position of the full-loaded condition position sensor, and the maximum stackable weight of the stacking tray 410, is found. Further, the "differential-weight equivalent number of paper sheets", defined as the number of the paper sheets equivalent to the differential weight above-defined, is to be found. In this connection, by counting the number of paper sheets, which have been stacked onto the stacking tray from the time point when the position of the stacking tray, currently descending, is detected by the full-loaded condition position sensor, it is determined that the stacking tray is in the full-loaded condition at the time when the counted number of paper sheets reaches the "differential-weight equivalent number of paper sheets", after commencing the counting. According to the process above-mentioned, with respect to various kinds of paper sheets, which are different from each other in weight and thickness thereof, it is possible to securely prevent the stacking tray from being overloaded by the paper sheets. In addition, it becomes possible to accurately stack the paper sheets onto the stacking tray until the weight of the stacked paper sheets reaches the maximum stackable weight.

Accordingly, even in such a case where paper sheets, having any one of various kinds of paper sizes, or other paper sheets, a specific weight of each of which is greater than that of a normal paper sheet, such as a pigment coated paper sheet or the like, are employed, it becomes possible to eliminate such a case that the weight of actually stacked paper sheets exceeds the maximum stackable weight. Therefore, it becomes possible to eliminate such a case that the stacking tray 410 and/or the up-and-down driving section 420 suffer from a large amount of mechanical burden.

Further, by combining the operation for detecting the position of the stacking tray 410 and the stacking operation based on the counted value of the "differential-weight equivalent number of paper sheets" with each other, it becomes possible to perform the operations for detecting the full loaded condition and controlling the stacking operation, securely and accurately, without arranging a large number of sensors in fine intervals. Accordingly, it becomes possible not only to reduce the cost for installing sensors, but also to alleviate the burden of a processing section that may process signals to be outputted by the sensors concerned.

Incidentally, sometimes, an operator may remove a part of or all of the paper sheets currently stacked on the stacking tray 410 in midcourse of operating the image forming apparatus 100 and/or the paper sheet processing apparatus 300. In this case, there is a possibility that, if the operator's removing action, above-mentioned, occurs in midcourse of implementing the counting operation after the full-loaded condition position sensor has turned ON (Step S117, shown in FIG. 3), the operation of the stacking tray 410 is deactivated at such a time point when the weight of the paper sheets, currently stacked thereon, has not reached the maximum stackable weight "Z" yet.

To solve the above-mentioned problem, when it is detected that the full-loaded condition position sensor turns OFF from ON in the counting operation after the full-loaded condition position sensor has turned ON (Step S117, shown in FIG. 3), the processing will be conducted as follows. Concretely speaking, the control section 301 stores a flag of "Full_sensor_on=0", which represents the fact that the full-loaded condition position sensor turns OFF from ON (Step S118, shown in FIG. 3), and then, resets the counted value (Step S119, shown in FIG. 3) acquired after the full-loaded condition position sensor has turned ON (Step S117, shown in FIG. 3).

Successively, by conducting the operation for detecting the fact that the full-loaded condition position sensor turns ON (Step S112, shown in FIG. 3) and the other operation for counting the paper sheets stacked after the full-loaded condition position sensor has turned ON (Step S117, shown in FIG. 3), the control section 301 resumes the operation for stacking the paper sheets for the remaining room until the weight of the paper sheet reaches the maximum stackable weight.

According to the above-mentioned process, it becomes possible to eliminate such a case that the stacking operation is deactivated based on the erroneous determination, made at the time when a part of or all of the paper sheets currently stacked on the stacking tray are removed from the stacking fray 410 in midcourse of the operation for stacking the paper sheet thereon. Accordingly, it becomes possible to manage the full loaded condition appropriately, so as to stack the paper sheets thereon accurately until the weight of the stacked paper sheets reaches the maximum stackable weight.

<Other Embodiments>

Referring to the drawings, the embodiment in accordance with the present invention has been described in the foregoing. However, the scope of the concrete configuration and the numerical values, which are in accordance with the present invention, is not limited to those indicated in the embodiment aforementioned. Namely, modifications and additions, made by a skilled person without departing from the spirit and scope of the invention, shall be included in the scope of the present invention.

According to the embodiment described in the foregoing, the control section 301 provided in the paper sheet processing apparatus 300 plays the central role for conducting the controlling operations. However, the scope of the present invention is not limited to the aforementioned. Namely, the control section 101 provided in the image forming apparatus 100 or another control section (not shown in the drawings) provided in the stacking section (or the paper sheet stacking apparatus) 400 may play the central role for conducting the controlling operations, as well.

Further, in a case where paper sheets, basis weight of each of which is relatively small, are stacked onto the stacking tray, it can be considered such a case that the height of the paper sheets stacked on the stacking tray exceeds an upper limit established for the stacking tray concerned, though the weight of the stacked paper sheets does not exceed the maximum stackable weight. In order to avoid the occurrence of such the case as above-mentioned, it is applicable that the full loaded condition is determined by using the height of the paper sheets stacked on the stacking tray, prior to the use of the weight thereof.

<Effects Acquired by Preferred Embodiment>

(1) When controlling the up-and-down driving section to drive the stacking tray 410 so as to keep a position of the upper-most surface of the paper sheets constant, and when determining whether or not the stacking tray 410 is currently in a full loaded condition, the control section selects any one of the plurality of sensors, provided in the position detecting section, as a full-loaded condition position sensor that indicates the full loaded condition of the stacking tray 410, by employing information in regard to a weight and a thickness of each of the paper sheets. Then, the control section determines whether or not the stacking tray is currently in the full loaded condition, based on the position of the stacking tray, which is detected by the full-loaded condition position sensor concerned. According to the controlling operations as above-mentioned, with respect to various kinds of paper sheets, which are different from each other in weight and thickness thereof, the overloaded condition caused by the overweight of the paper sheets does not occur. Accordingly, it becomes possible to manage the full loaded condition appropriately, even if the paper sheets, currently stacked on the staking tray, are accidentally removed in midcourse of the stacking operation concerned.

(2) In the paper sheet stacking apparatus recited in above-item (1), when conducting the controlling operation for determining whether or not the stacking tray is currently in the full loaded condition, based on the position of the stacking tray, the control section calculates the thickness of the paper sheet, based on a number of the paper sheets stacked onto the stacking tray and a position of any one of the plurality of sensors provided in the position detecting section. According to the above-mentioned feature of the present embodiment, since the thickness of the paper sheet can be found accurately, it becomes possible to appropriately select the full-loaded condition position sensor by employing the information representing the weight of the paper sheets and the other information representing the above-calculated thickness of the paper sheet. Further, since it is possible to accurately determine the full loaded condition of the stacking tray 410 by using the position of the stacking tray 410, which is detected by the full-loaded condition position sensor, with respect to various kinds of paper sheets, which are different from each other in weight and thickness thereof, the overloaded condition caused by the overweight of the paper sheets does not occur. Still further, it becomes possible to manage the full loaded condition appropriately, even if the paper sheets, currently stacked on the staking tray, are accidentally removed in midcourse of the stacking operation concerned.

(3) In the paper sheet stacking apparatus recited in above-items (1) and (2), by employing the information in regard to the weight and the thickness of each of the paper sheets, the control section selects a sensor, which is disposed at such a position at which the stacking tray enters into an overweight condition, as an overweight position sensor among the plurality of sensors provided in the position detecting section, and further selects another sensor, which is disposed at a one-stage upper position from the overweight position sensor, as a full-loaded condition position sensor among the plurality of sensors. According to the above-mentioned feature of the present embodiment, with respect to various kinds of paper sheets, which are different from each other in weight and thickness thereof, it becomes possible to securely prevent the stacking tray from entering into the overloaded condition caused by the overweight of the paper sheets. Further, it becomes possible to manage the full loaded condition appropriately, even if the paper sheets, currently stacked on the staking tray, are accidentally removed in midcourse of the stacking operation concerned.

(4) In the paper sheet stacking apparatus recited in above-item (3), the control section finds a differential weight, defined as a difference between the weight of the paper sheets, stacked on the stacking tray 410 currently positioned at the full-loaded condition position sensor, and a maximum stackable weight of the stacking tray 410, and then, finds a "differential-weight equivalent number of paper sheets", defined as a number of the paper sheets equivalent to the differential weight. Further, at the time when the position of the stacking tray 410, currently descending, is detected by the full-loaded condition position sensor, the control section starts to count a number of paper sheets stacked, and then, at the other time when the number of the paper sheets stacked reaches the "differential-weight equivalent number of paper sheets", the control section determines that the stacking tray 410 has entered into the full-loaded condition. According to the above-mentioned feature of the present embodiment, with respect to various kinds of paper sheets, which are different from each other in weight and thickness thereof, it becomes possible to securely prevent the stacking tray from entering into the overloaded condition caused by the overweight of the paper sheets. Further, it becomes possible to accurately stack the paper sheets until the number of the paper sheets, currently stacked, reaches the maximum stackable weight.

(5) In the paper sheet stacking apparatus recited in above-item (4), in midcourse of a counting operation for counting the number of the paper sheets stacked from the time when the position of the stacking tray is detected by the full-loaded condition position sensor, in case where it is detected that the stacking tray elevates up to such a position that is higher than that of the full-loaded condition position sensor, the control section resets a current value above-counted, and then, resumes the counting operation at the time when the position of the stacking tray, currently descending, is detected by the full-loaded condition position sensor. Successively, after resuming the counting operation, at the other time when the number of the paper sheets stacked reaches the "differential-weight equivalent number of paper sheets", the control section determines that the stacking tray has entered into the full-loaded condition. According to the above-mentioned feature of the present embodiment, with respect to various kinds of paper sheets, which are different from each other in weight and thickness thereof, it becomes possible to securely prevent the stacking tray from entering into the overloaded condition caused by the overweight of the paper sheets. Further, it becomes possible to accurately stack the paper sheets until the number of the paper sheets, currently stacked, reaches the maximum stackable weight.

What is claimed is:

1. A paper sheet stacking apparatus that stacks paper sheets having been ejected thereto, the paper sheet stacking apparatus comprising:

a stacking tray to stack the paper sheets;

an up-and-down driving section to drive the stacking tray up and down in a vertical direction corresponding to a height direction of the paper sheets when stacked;

a paper-sheet upper surface detecting section to detect an upper-most surface of the paper sheets stacked onto the stacking tray;

a position detecting section to detect a position of the stacking tray by using a plurality of sensors respectively disposed at different positions along the vertical direction in which the stacking tray moves up and down; and a control section that controls the up-and-down driving section to drive the stacking tray so as to keep a position of the upper-most surface of the paper sheets, which is detected by the paper-sheet upper surface detecting section, constant, and determines whether or not the stacking tray is currently in a full loaded condition, based on the position of the stacking tray detected by the position detecting section;

wherein the control section confirms information regarding a weight of the paper sheets, calculates a thickness of each of the paper sheets based on a number of the paper sheets stacked onto the stacking tray and a position of any one of the plurality of sensors provided in the position detecting section, selects any one of the plurality of sensors as a full-loaded condition position sensor that indicates the full loaded condition of the stacking tray based on the information regarding the weight of the paper sheets and the calculated thickness of each of the paper sheets, and determines whether or not the stacking tray is currently in the full loaded condition, based on the position of the stacking tray, which is detected by the full-loaded condition position sensor.

2. The paper sheet stacking apparatus of claim 1, wherein, based on the information regarding the weight of the paper sheets and the calculated thickness of each of the paper sheets, the control section selects a sensor, which is disposed at a position at which the stacking tray enters into an overweight condition, as an overweight position sensor from among the plurality of sensors provided in the position detecting section, and further selects another sensor, which is disposed at a one-stage upper position from the overweight position sensor, as the full-loaded condition position sensor.

3. The paper sheet stacking apparatus of claim 2, wherein the control section finds a differential weight, which is defined as a difference between (i)the weight of the paper sheets stacked on the stacking tray when the stacking tray is positioned at the full-loaded condition position sensor and (ii) a maximum stackable weight of the stacking tray, and then finds a "differential-weight equivalent number of paper sheets", which is defined as a number of the paper sheets equivalent to the differential weight; and wherein, at a time at which the position of the stacking tray, while descending, is detected by the full-loaded condition position sensor, the control section begins counting a number of paper sheets stacked, and then, at another time at which the number of the paper sheets stacked reaches the "differential-weight equivalent number of paper sheets", the control section determines that the stacking tray has entered into the full-loaded condition.

4. The paper sheet stacking apparatus of claim 3, wherein, while performing a counting operation for counting the number of the paper sheets stacked from the time at which the position of the stacking tray is detected by the full-loaded condition position sensor, when it is detected that the stacking tray elevates up to a position that is higher than a position of the full-loaded condition position sensor, the control section resets a current value obtained by performing the counting operation, and then resumes the counting operation at the time at which the position of the stacking tray, while descending, is detected by the full-loaded condition position sensor; and wherein, after resuming the counting operation, at the time at which the number of the paper sheets stacked reaches the "differential-weight equivalent number of paper sheets", the control section determines that the stacking tray has entered into the full-loaded condition.

5. An image forming apparatus, comprising:

an image forming section to form an image on a paper sheet;

an ejecting section to eject the paper sheet on which the image is formed;

a stacking tray to stack the paper sheet, ejected by the ejecting section, thereon;

an up-and-down driving section to drive the stacking tray up and down in a vertical direction corresponding to a height direction of paper sheets when stacked on the stacking tray;

a paper-sheet upper surface detecting section to detect an upper-most surface of the paper sheets stacked onto the stacking tray;

a position detecting section to detect a position of the stacking tray by using a plurality of sensors respectively disposed at different positions along the vertical direction in which the stacking tray moves up and down; and a control section that controls the up-and-down driving section to drive the stacking tray so as to keep a position of the upper-most surface of the paper sheets, which is detected by the paper-sheet upper surface detecting section, constant, and determines whether or not the stacking tray is currently in a full loaded condition, based on the position of the stacking tray detected by the position detecting section;

wherein the control section confirms information regarding a weight of the paper sheets, calculates a thickness of each of the paper sheets based on a number of the paper sheets stacked onto the stacking tray and a position of any one of the plurality of sensors provided in the position detecting section, selects any one of the plurality of sensors as a full-loaded condition position sensor that indicates the full loaded condition of the stacking tray based on the information regarding the weight of the paper sheets and the calculated thickness of each of the paper sheets, and determines whether or not the stacking tray is currently in the full loaded condition, based on the position of the stacking tray, which is detected by the full-loaded condition position sensor.

6. A paper sheet processing apparatus, comprising:

a paper sheet processing section to apply a paper sheet processing to a paper sheet;

an ejecting section to eject the paper sheet to which the paper sheet processing is applied;

a stacking tray to stack the paper sheet, ejected by the ejecting section, thereon;

an up-and-down driving section to drive the stacking tray up and down in a vertical direction corresponding to a height direction of paper sheets when stacked on the stacking tray;

a paper-sheet upper surface detecting section to detect an upper-most surface of the paper sheets stacked onto the stacking tray;

a position detecting section to detect a position of the stacking tray by using a plurality of sensors respectively disposed at different positions along the vertical direction in which the stacking tray moves up and down; and a control section that controls the up-and-down driving section to drive the stacking tray so as to keep a position of the upper-most surface of the paper sheets, which is detected by the paper-sheet upper surface detecting section, constant, and determines whether or not the stacking tray is currently in a full loaded condition, based on the position of the stacking tray detected by the position detecting section;

wherein the control section confirms information regarding a weight of the paper sheets, calculates a thickness of each of the paper sheets based on a number of the paper sheets stacked onto the stacking tray and a position of any one of the plurality of sensors provided in the position detecting section, selects any one of the plurality of sensors as a full-loaded condition position sensor that indicates the full loaded condition of the stacking tray based on the information regarding the weight of the paper sheets and the calculated thickness of each of the paper sheets, and determines whether or not the stacking tray is currently in the full loaded condition, based on the position of the stacking tray, which is detected by the full-loaded condition position sensor.

7. An image forming system, comprising:

an image forming section to form an image on a paper sheet;

a paper sheet processing section to apply a paper sheet processing to the paper sheet on which the image is formed;

an ejecting section to eject the paper sheet to which the paper sheet processing is applied;

a stacking tray to stack the paper sheet, ejected by the ejecting section, thereon;

an up-and-down driving section to drive the stacking tray up and down in a vertical direction corresponding to a height direction of paper sheets when stacked on the stacking tray;

a paper-sheet upper surface detecting section to detect an upper-most surface of the paper sheets stacked onto the stacking tray;

a position detecting section to detect a position of the stacking tray by using a plurality of sensors respectively disposed at different positions along the vertical direction in which the stacking tray moves up and down; and a control section that controls the up-and-down driving section to drive the stacking tray so as to keep a position of the upper-most surface of the paper sheets, which is detected by the paper-sheet upper surface detecting section, constant, and determines whether or not the stacking tray is currently in a full loaded condition, based on the position of the stacking tray detected by the position detecting section;

wherein the control section confirms information regarding a weight of the paper sheets, calculates a thickness of each of the paper sheets based on a number of the paper sheets stacked onto the stacking tray and a position of any one of the plurality of sensors provided in the position detecting section, selects any one of the plurality of sensors as a full-loaded condition position sensor that indicates the full loaded condition of the stacking tray based on the information regarding the weight of the paper sheets and the calculated thickness of each of the paper sheets, and determines whether or not the stacking tray is currently in the full loaded condition, based on the position of the stacking tray, which is detected by the full-loaded condition position sensor.

8. A method for controlling a paper sheet stacking operation which is implemented in a paper sheet stacking apparatus that stacks paper sheets having been ejected thereto, the apparatus comprising a stacking tray to stack the paper sheets; an up-and-down driving section to drive the stacking tray up and down in a vertical direction corresponding to a height direction of the paper sheets when stacked; a paper-sheet upper surface detecting section to detect an upper-most surface of the paper sheets stacked onto the stacking tray; a position detecting section to detect a position of the stacking tray by using a plurality of sensors respectively disposed at different positions along the vertical direction in which the stacking tray moves up and down; and a control section that controls the up-and-down driving section to drive the stacking tray so as to keep a position of the upper-most surface of the paper sheets, which is detected by the paper-sheet upper surface detecting section, constant, and determines whether or not the stacking tray is currently in a full loaded condition, based on the position of the stacking tray, detected by the position detecting section, and the method comprising:

confirming information regarding a weight of the paper sheets;

calculating a thickness of each of the paper sheets based on a number of the paper sheets stacked onto the stacking tray and a position of any one of the plurality of sensors provided in the position detecting section;

selecting any one of the plurality of sensors as a full-loaded condition position sensor that indicates the full loaded condition of the stacking tray based on the information regarding the weight of the paper sheets and the calculated thickness of each of the paper sheets; and determining whether or not the stacking tray is currently in the full loaded condition, based on the position of the stacking tray which is detected by the full-loaded condition position sensor.

9. The method of claim 8, further comprising:

selecting a sensor, which is disposed at a position at which the stacking tray enters into an overweight condition, as an overweight position sensor from among the plurality of sensors provided in the position detecting section, based on the information regarding the weight of the paper sheets and the calculated thickness of each of the paper sheets; and further selecting another sensor, which is disposed at a one-stage upper position from the overweight position sensor, as the full-loaded condition position sensor.

10. The method of claim 9, further comprising:

finding a differential weight, which is defined as a difference between (i) the weight of the paper sheets stacked on the stacking tray when the stacking tray is positioned at the full-loaded condition position sensor and (ii) a maximum stackable weight of the stacking tray;

successively finding a "differential-weight equivalent number of paper sheets", which is defined as a number of the paper sheets equivalent to the differential weight;

counting a number of paper sheets stacked at a time at which the position of the stacking tray, while descending, is detected by the full-loaded condition position sensor; and determining that the stacking tray has entered into the full-loaded condition at another time at which the number of the paper sheets stacked reaches the "differential-weight equivalent number of paper sheets".

11. The method of claim 10, further comprising, while performing a counting operation for counting the number of the paper sheets stacked from the time at which the position of the stacking tray is detected by the full-loaded condition position sensor:

resetting a current value obtained by performing the counting operation when it is detected that the stacking tray elevates up to a position that is higher than a position of the full-loaded condition position sensor;

resuming the counting operation at the time at which the position of the stacking tray, while descending, is detected by the full-loaded condition position sensor; and after resuming the counting operation, determining that the stacking tray has entered into the full-loaded condition at the time at which the number of the paper sheets stacked reaches the "differential-weight equivalent number of paper sheets".

12. The paper sheet stacking apparatus of claim 1, wherein the control section confirms the information regarding the weight of the paper sheets by confirming paper-sheet basis weight information and paper sheet size information, and calculating the weight of the paper sheets based on the paper-sheet basis weight information and the paper sheet size information.

13. The paper sheet stacking apparatus of claim 1, wherein the control section continues to stack the paper sheets onto the stacking tray when the stacking tray is indicated to be in the full loaded condition by the full-loaded condition position sensor, compares the weight of the paper sheets stacked on the stacking tray with a maximum stackable weight, and determines whether or not the stacking tray is currently in the full loaded condition based on a result of the comparison.

14. The paper sheet stacking apparatus of claim 1, wherein the control section confirms information of a distance between the paper-sheet upper surface detecting section and the full-loaded condition position sensor, calculates the weight of the paper sheets stacked on the stacking tray based on the information of the distance, the calculated thickness of each of the paper sheets, and the information regarding the weight of the paper sheets, compares the weight of the paper sheets stacked on the stacking tray with a maximum stackable weight, and determines whether or not the stacking tray is currently in the full loaded condition based on a result of the comparison.

15. The method of claim 8, wherein the confirming the information regarding the weight of the paper sheets comprises confirming paper-sheet basis weight information and paper sheet size information, and calculating the weight of the paper sheets based on the paper-sheet basis weight information and the paper sheet size information.

16. The method of claim 8, further comprising continuing to stack the paper sheets onto the stacking tray when the stacking tray is indicated to be in the full loaded condition by the full-loaded condition position sensor, comparing the weight of the paper sheets stacked on the stacking tray with a maximum stackable weight, and determining whether or not the stacking tray is currently in the full loaded condition based on a result of the comparison.

17. The method of claim 8, further comprising confirming information of a distance between the paper-sheet upper surface detecting section and the full-loaded condition position sensor, calculating the weight of the paper sheets stacked on the stacking tray based on the information of the distance, the calculated thickness of each of the paper sheets, and the information regarding the weight of the paper sheets, comparing the weight of the paper sheets stacked on the stacking tray with a maximum stackable weight, and determining whether or not the stacking tray is currently in the full loaded condition based on a result of the comparison.

18. A paper sheet stacking system comprising an image forming apparatus and the paper sheet stacking apparatus according to claim 1.

* * * * *